US005634347A

United States Patent [19]

Hanson et al.

[11] Patent Number: 5,634,347

[45] Date of Patent: Jun. 3, 1997

[54] METHOD OF CONTROLLING A TRANSPORT REFRIGERATION SYSTEM WITHOUT REFRIGERANT MODULATION

[75] Inventors: Jay L. Hanson, Bloomington; Doyle G. Herrig, Elko, both of Minn.

[73] Assignee: Thermo King Corporation, Minneapolis, Minn.

[21] Appl. No.: 630,289

[22] Filed: Apr. 10, 1996

[51] Int. Cl.[6] ..... F25B 49/02

[52] U.S. Cl. ..... 62/120; 62/158; 62/208; 62/160; 62/228.4; 62/229

[58] Field of Search ..... 62/117, 157, 158, 62/208, 209, 203, 231, 228.4, 228.5, 229, 120, 160, 159

[56] References Cited

U.S. PATENT DOCUMENTS

| | | | |
|---|---|---|---|
| 4,493,191 | 1/1985 | Hanson | 62/158 X |
| 4,519,215 | 5/1985 | Barnett | 62/229 X |
| 5,172,560 | 12/1992 | Jurewicz et al. . | |
| 5,209,072 | 5/1993 | Truckenbrod et al. | 62/208 X |
| 5,295,364 | 3/1994 | Truckenbrod et al. | 62/229 X |
| 5,355,686 | 10/1994 | Weiss | 62/158 X |

*Primary Examiner*—Harry B. Tanner

[57] ABSTRACT

A method for controlling a transport refrigeration system is provided that advantageously avoids the top-freezing of items stored in a conditioned space without the need for modulating the flow of refrigerant through the heater-evaporator coil that heats and cools the space. The method includes the steps of operating the refrigeration system in a cooling mode at high speed for no more than 300° minutes below the temperature set point of the conditioned space to rapidly cool the space. Next, the system is operated in a low speed heating mode in order to raise the temperature of the conditioned space to no more than about 5° F. above set point in order to avoid top-freezing items in the conditioned space. Thirdly, the refrigeration system is operated in a low speed cooling mode to reattain a temperature set point assigned to the conditioned space. If necessary, these three basic steps of the method may be reiterated in order to stabilize the temperature of the space at set point. The method is particularly applicable to refrigeration systems capable of cooling or heating multiple conditioned spaces.

20 Claims, 5 Drawing Sheets

METHOD OF CONTROLLING A TRANSPORT REFRIGERATION SYSTEM WITHOUT REFRIGERANT MODULATION

BACKGROUND OF THE INVENTION

This invention generally relates to refrigeration systems, and is specifically concerned with a method for controlling a transport refrigeration system that prevents undesirable top-freezing of items stored in the conditioned space without modulating the amount of refrigerant flowing through the system heater-evaporator coil.

Methods for controlling transport refrigeration systems in a manner that prevents top-freezing are known in the prior art. An example of such a method is disclosed and claimed in U.S. Pat. No. 5,172,560, likewise assigned to the Thermo King Corporation located in Minneapolis, Minn. The refrigeration system itself generally comprises a refrigerant compressor driven by a diesel engine, at least one evaporator-heater coil, and a fan for discharging a flow of air through the coil to cool or heat a conditioned space to a selected temperature setpoint. Such systems further include a sensor for measuring the temperature of the discharged air from the fan, as well as a sensor for measuring the temperature of air that has circulated through the conditioned space. Such systems may be operated in either a cooling or a heating mode wherein either an expanded or compressed refrigerant is circulated through the evaporator-heater coil. Such systems may be operated in either a high speed or a low speed mode corresponding to either the 2200 rpm or 1400 rpm speed that the diesel engine is conventionally operated.

In prior art methods for operating such refrigeration systems, the system is initially operated in a cooling mode at high speed to effect an initial temperature pull down that rapidly brings the temperature of the conditioned space (as measured by the temperature of the return air) to a control temperature that is somewhat higher than the setpoint. As soon as the control temperature is obtained, the system continues to operate in a high speed cooling mode while a controlled amount of hot gas is injected into the evaporator-heater coil via the hot gas injection valve. The introduction of such hot gas into the coil slows the rate of temperature drop in the conditioned space. As the system achieves a second control temperature even closer to setpoint, it is operated at low speed while hot gas continues to be injected into the coil through the hot gas injection valve, thus further slowing the rate of temperature drop in the conditioned space. Thus temperature overshoot in the conditioned space is prevented, and stability around setpoint is attained by the modulation of the refrigerant entering the evaporator-heater coil via the hot gas injection valve, which acts as an ever increasing thermal "brake" as setpoint is approached. The prevention of such temperature overshoot is highly desirable, as it prevents potentially damaging top-freezing from occurring to the goods stored in the conditioned space.

While such control methods have proven their practicality in the field, the applicants have noted a number limitations of such methods that impair their usefulness. For example, such methods are not readily adaptable for use in refrigeration systems having multiple compartments that are maintained at different temperatures. In such systems, a single refrigerant compressor and diesel engine drives a plurality of evaporator-heater coils and fans to individually cool or heat each of the various spaces, and no special valves or other mechanisms are normally provided for the controlled modulation of hot gas in each of the various evaporator-heater coils. Moreover, even in refrigeration systems having only a single evaporator-heater coil and fan for conditioning only a single space, it would be desirable to have a control method that did not rely upon a hot gas modulation valve since such valves are relatively expensive and complex mechanisms.

Clearly, there is a need for an improved method for controlling a transport refrigeration system that does not rely upon a hot gas modulation valve, but yet which is capable of rapidly pulling a conditioned space down to a selected temperature setpoint without the occurrence of temperature overshoot that can cause undesirable top freezing of the items stored in the conditioned space.

SUMMARY OF THE INVENTION

Generally speaking, the invention is a method for controlling a transport refrigeration system that effectively prevents top-freezing without the need for refrigerant modulation, and the relatively expensive valve mechanism associated therewith. The method is particularly adapted for use with a refrigeration system with the type having multiple conditioned spaces, each of which is cooled or heated by its own combination of an evaporator coil and air discharge fan, all of which are powered by the same refrigerant compressor and prime mover. However, the method of the invention is also applicable to refrigeration systems having only a single coil and fan combination for cooling or heating a single conditioned space.

In the first step of the method of the invention, the refrigeration system is operated in a cooling mode at high speed for up to 300° F. minutes below temperature setpoint in order to rapidly cool down the conditioned space. Next, the system is operated in a heating mode at low speed to raise the temperature of the conditioned space to a predetermined number of degrees above setpoint in order to avoid top-freezing of items stored in the conditioned space. In single-space refrigeration systems incapable of running in a null mode wherein the coil fan blows but no refrigerant flows through the evaporator-heater coil, this step of the method lasts until the temperature of the discharge air is approximately 5° F. above setpoint. In refrigeration systems that are capable of operating in a null mode, which typically includes systems capable of cooling or heating multiple conditioned spaces, each evaporator coil and discharge fan combination is operated until its respective conditioned space is heated to approximately 2° F. above setpoint. Afterward, the particular coil and fan combination is operated in a null mode until its respective conditioned space rises to approximately 5° F. above setpoint. In the third step of the method, the system is then operated in a cooling mode at low speed in order to reattain the temperature setpoint of the conditioned space.

If the continuing operation of the system in a low speed cooling mode results in the temperature of the discharge air falling below the setpoint of the particular conditioned space, then the microprocessor that implements the method notes time that the discharge air temperature and setpoint temperature converged, and then allows the system to continue to operate for either a maximum time limit of 200° F. minutes, or until the temperature of the return air in the conditioned space is equal to the setpoint, whereupon the system is again operated in a low speed heating mode until the space becomes no more than 1.7° F. above setpoint, whereupon the system is again operated at a low speed cooling mode to reattain setpoint.

The method is applicable to refrigeration systems that cool either a single or a plurality of conditioned spaces, and advantageously achieves setpoint in a minimum amount of time without undesirable top-freezing of items within the conditioned space.

BRIEF DESCRIPTION OF THE SEVERAL FIGURES

FIG. 1 is a schematic representation of a prior art transport refrigeration system for heating and cooling a single conditioned space which utilizes a hot gas modulation valve in order to achieve temperature setpoint;

FIG. 2 schematically illustrates a transport refrigeration system for heating and cooling a single conditioned space that operates according to the method of the invention without a hot gas modulation valve;

DETAILED DESCRIPTION OF THE PREFERRED EMBODIMENTS

Figure 1:
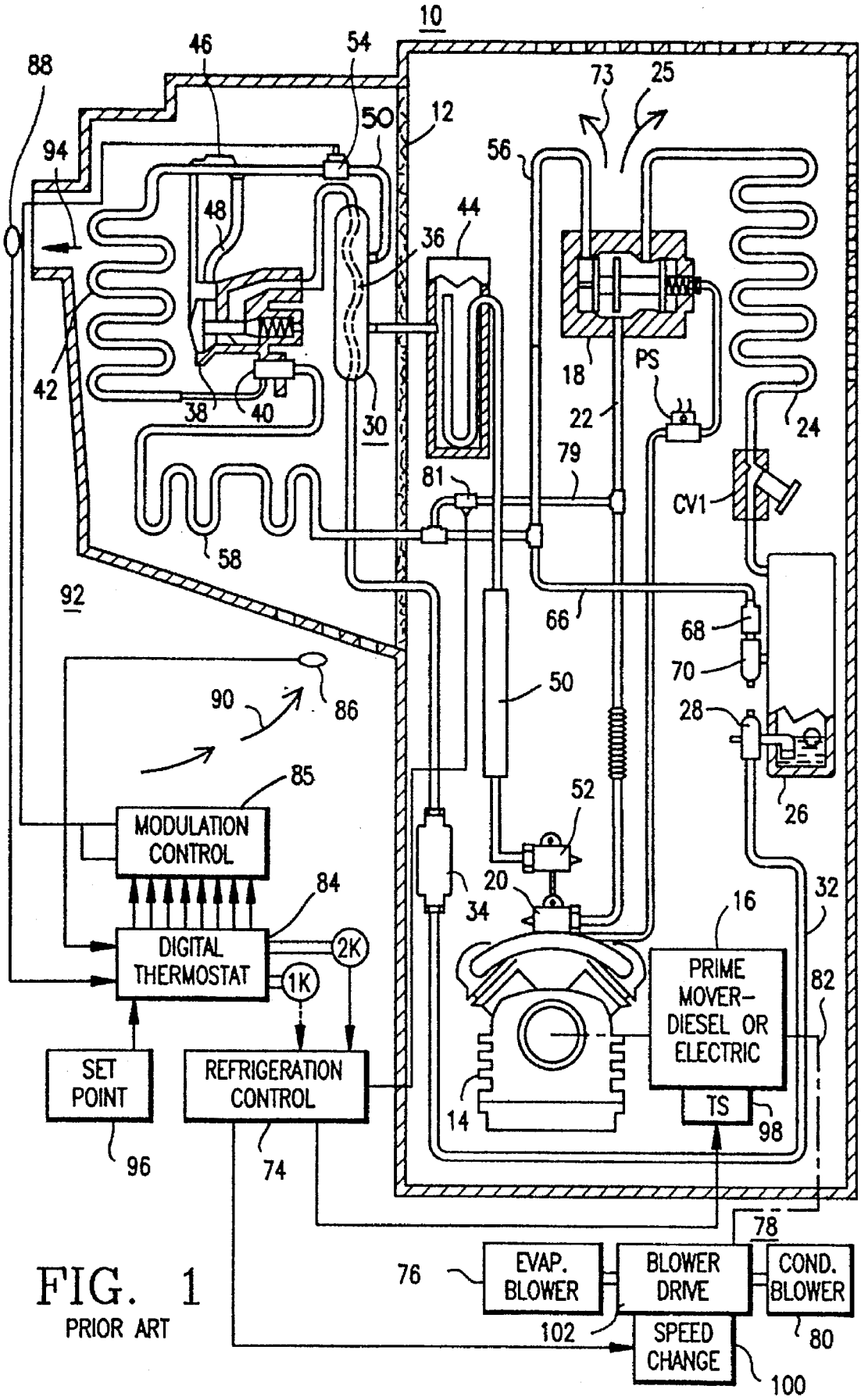
FIG. 1 PRIOR ART

FIG. 1 illustrates a prior art refrigeration system having a hot-gas modulation valve for implementing a method of temperature control. This prior art system 10 is mounted on a wall 12 of a served spaced to be conditioned, such as a truck, trailer, or container. Refrigeration system 10 includes a closed fluid refrigerant circuit having a refrigerant compressor 14 driven by a prime mover, which may be a diesel engine or an electric motor, indicated at 16. Discharge ports of compressor 14 are connected to an inlet port of three-way valve 18 via a discharge service valve 20 and a hot gas conduit or line 22. The functions of three-way valve 18 which has two output ports for operating the system 10 in either a cooling mode or a heating mode. The cooling outlet port of three-way valve 18 is connected to the inlet side of a condenser coil 24 to initiate a first refrigerant circuit 25. The outlet side of condenser coil 24 is connected to the inlet side of a refrigerant receiver tank 26 via a condenser check valve CV1, which enables fluid flow only from condenser coil 24 to receiver tank 26. An outlet valve 28 on receiver tank 26 is connected to a heat exchanger 30 via a liquid line 32 which may include a dryer or dehydrator 34.

Liquid refrigerant from liquid line 32 continues through a coil 36 of heat exchanger 30 to expansion means 38, such as the expansion valve illustrated. Expansion valve 38 is controlled by an expansion valve thermal bulb 46 and a pressure equalizer line 48. The outlet of expansion valve 38 is connected to a refrigerant distributor 40 which distributes refrigerant to the inlets of a plurality of refrigerant circuits on the inlet side of an evaporator-heater coil 42. The outlet side of evaporator-heater coil 42, which initiates the low pressure or suction side of the refrigeration circuit 25, is connected to the suction side of compressor 14.

The suction or low pressure side of refrigeration system 10 includes a suction line 50 having a modulation valve 54 for modulating a flow of hot gases into the evaporator-heater coil 42. Line 50 further includes a path through the heat exchanger 30, and ends at accumulator tank 44. Gaseous refrigerant in accumulator tank 44 is directed from the outlet side thereof to a suction port of compressor 14 via another section of suction line 50, and a suction line service valve 52. As illustrated, modulation valve 54 is preferably located in a portion of suction line 50 which is adjacent to the outlet of evaporator 42 and prior to heat exchanger 30 and accumulator 44 in order to protect the compressor by utilizing the volumes of these devices to accommodate any liquid refrigerant surges which may occur while modulation valve 54 is in operation.

The heating mode output port of three-way valve 18 is connected to a hot gas line 56 which extends from three-way valve 18 to the refrigerant distributor 40 and thus the inlet side of evaporator coil 42 via a defrost pan heater 58 located below the evaporator-heater coil 42. A bypass conduit or pressurizing tap 66 may extend from hot gas line 56 to receiver tank 26 via bypass and service check valves 68 and 70, respectively, in order to force refrigerant from receiver 26 during a heat mode, such as used to hold setpoint or to defrost evaporator-heater coil 42.

A conduit 72 connects three-way valve 18 to the intake side of compressor 14 via a normally closed pilot solenoid valve PS. When solenoid operated valve PS is closed, three-way valve 18 is spring biased to the cooling mode position to direct hot, high pressure refrigerant vapor into the first refrigerant circuit 25 which includes condenser 24. Condenser 24 removes heat from the vapor and condenses it into a lower pressure liquid. When evaporator-heater coil 42 requires defrosting, and also when a heating mode is required to hold the selected thermostat setpoint within the conditioned space, pilot solenoid PS is opened via voltage provided by a refrigeration control circuit 74. Three-way valve 18 is then operated in its heating mode position which directs refrigerant in the form of hot, high pressure vapor to the evaporator-heater coil via hot gas line 56, defrost pan heater 58, and distributor 40 bypassing expansion valve 38. If the heating mode is initiated in response to a defrost requirement, no air is discharged into the conditioned space indicated generally at 92 during the defrost time. During a heating cycle required to hold a thermostat setpoint temperature, and during a cooling mode, an evaporator fan or blower 76 (driven by prime mover 16) directs conditioned air into the conditioned space 92. Evaporator blower 76 is part of air delivery system 78 which also includes a condenser fan or blower 80. Air delivery system 78 is driven by prime mover 16, such as a pulley and belt arrangement indicated generally by broken line 82.

A hot gas bypass line 79 interconnects hot gas line 22 in the inlet side of the evaporator-heater coil 42. A solenoid operated valve 81 is disposed in the bypass line 79. While valve 81 may be a controllable modulation type valve, a simple on/off solenoid valve is sufficient to perform the method of the invention. The size of bypass line 79 is selected to provide the desired amount of hot gas injection into the evaporator-heater coil 42 when valve 81 is operated in an open position.

Refrigeration control circuit 74 includes a thermostat 84 having temperature sensors 86 and 88. Temperature sensor 86 is disposed to detect the temperature of the air returning to the evaporator blower 76 from the conditioned space 92, with the return air being indicated by arrows 90. Temperature sensor 88 is disposed to detect the temperature of conditioned air being discharged by the evaporator blower 76 through the evaporator-heater coil 42 and back into the conditioned space 92, with the discharged air being indicated by arrow 94. Thermostat 84 includes setpoint selector means 96 for selecting a desired setpoint temperature to which the system 10 will control the temperature of the return air 90. As illustrated, thermostat 84 also provides output signals for use by a modulation controller 85, which controls the opening and closing of suction line modulation valve 54.

Signals provided by thermostat 84 control heat and speed relays 1 K and 2 K, respectively, which have contacts in refrigeration control circuit 74. Heat relay 1 K is de-energized when system 10 should be in a cooling mode, and it is energized when the system 10 should be in a heating or defrost mode. Speed relay 2 K is de-energized when the system 10 is operated by prime mover at low speed, e.g., 1400 rpms, and is energized when the prime mover 16 is operating the system 10 at high speed, e.g., 2200 rpms. Contacts of heat relay 1 K, for example, are connected in refrigeration control 74 to de-energize and energize pilot solenoid valve PS, to select cooling and heating modes, respectively. Contacts of speed relay 2 K, for example, are connected in refrigeration control 74 to de-energize and energize a throttle solenoid 98 associated with prime mover 16, for selecting the high and low speeds, respectively.

The function of thermostat 84 and modulation controller 85 may be performed by a computer, such as disclosed in U.S. Pat. No. 4,918,932, assigned to the same assignee as the present application, the entire text of which is expressly incorporated herein by reference.

The refrigeration control circuit 74 provides a control air in response to a predetermined relationship between the setpoint temperature entered by the setpoint selector 96, and the temperature of the served space 92 is indicated by sensors 86 and 88. The control air may simply be a straight proportional function of the difference between the selected setpoint temperature, and the temperature detected by one of the sensors, such as the return air sensor 86, or the difference between setpoint and the average value of the two sensors. In a preferred embodiment, control 74 includes a digital computer and the control air is calculated using the values provided by both sensors 86 and 88. For example, the control air may be calculated as disclosed in the hereinbefore mentioned U.S. Pat. No. 4,918,932, which sums three calculations, a proportional air, and an integral air, and a floor air, to provide a control air which controls refrigeration system 10 according to the distance of the control air from the selected setpoint temperature. Circuit 74 provides such a control air by opening and closing valve 81, and by adjusting the speed of the blowers 76, 80 via speed change circuit 100 and blower drive 102.

Control of the desired coil current of suction line modulation valve 54 to obtain the desired valve position at predetermined control air values may be by computer in response to the calculated control air value at any instant. For example, the control air value may be used to address look-up tables stored in computer memory to obtain digital output signals which turn on or off predetermined switches in a matrix of resistors. The resistors are combined in different parallel combinations to provide the desired resistance in an electrical circuit which includes the control coil of modulation valve 54. Or, a digital signal may be provided by thermostat 84 which controls modulation control 85 having such a resistive network.

Figure 2:
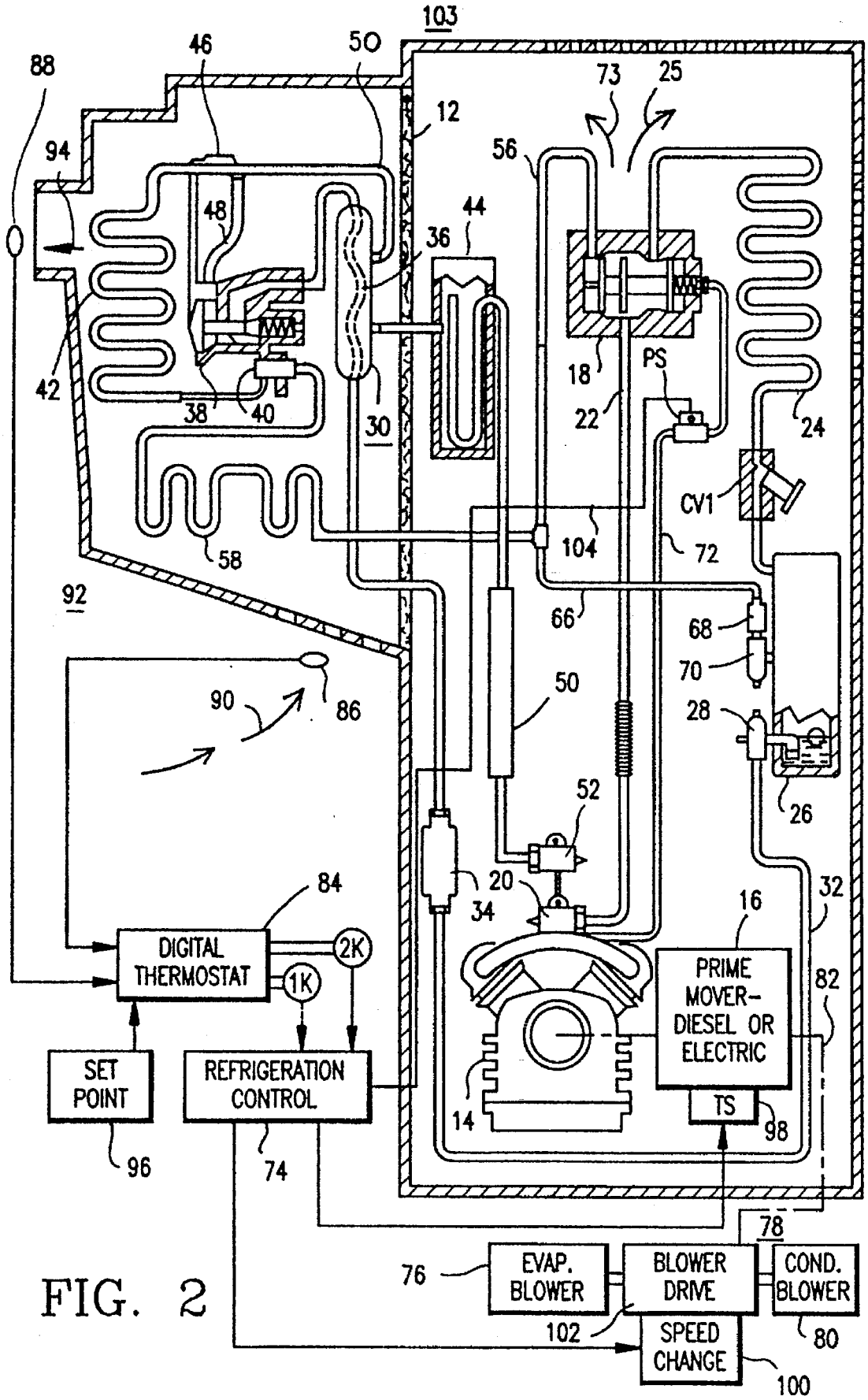

With reference now to FIG. 2, a refrigeration system 103 that is capable of implementing the method of the invention is, in all respects identical to the prior art system illustrated in FIG. 1, with three notable exceptions. First, the system 103 require no hot gas modulation valve 54. Secondly, the system 103 requires no bypass line 79 for providing hot gas to the valve 54. Thirdly, the system 103 requires no separate modulation circuit 85 for controlling the valve 54. Instead, similar to the previously described prior art system 10, refrigeration system 103 includes a line 104 connected between the refrigeration control circuit and solenoid PS for switching the operation of the system 103 from a cooling to a heating mode and vice versa. Like the previously described system 10, refrigeration system 103 is capable of heating or cooling a single conditioned space 92.

Figure 3:
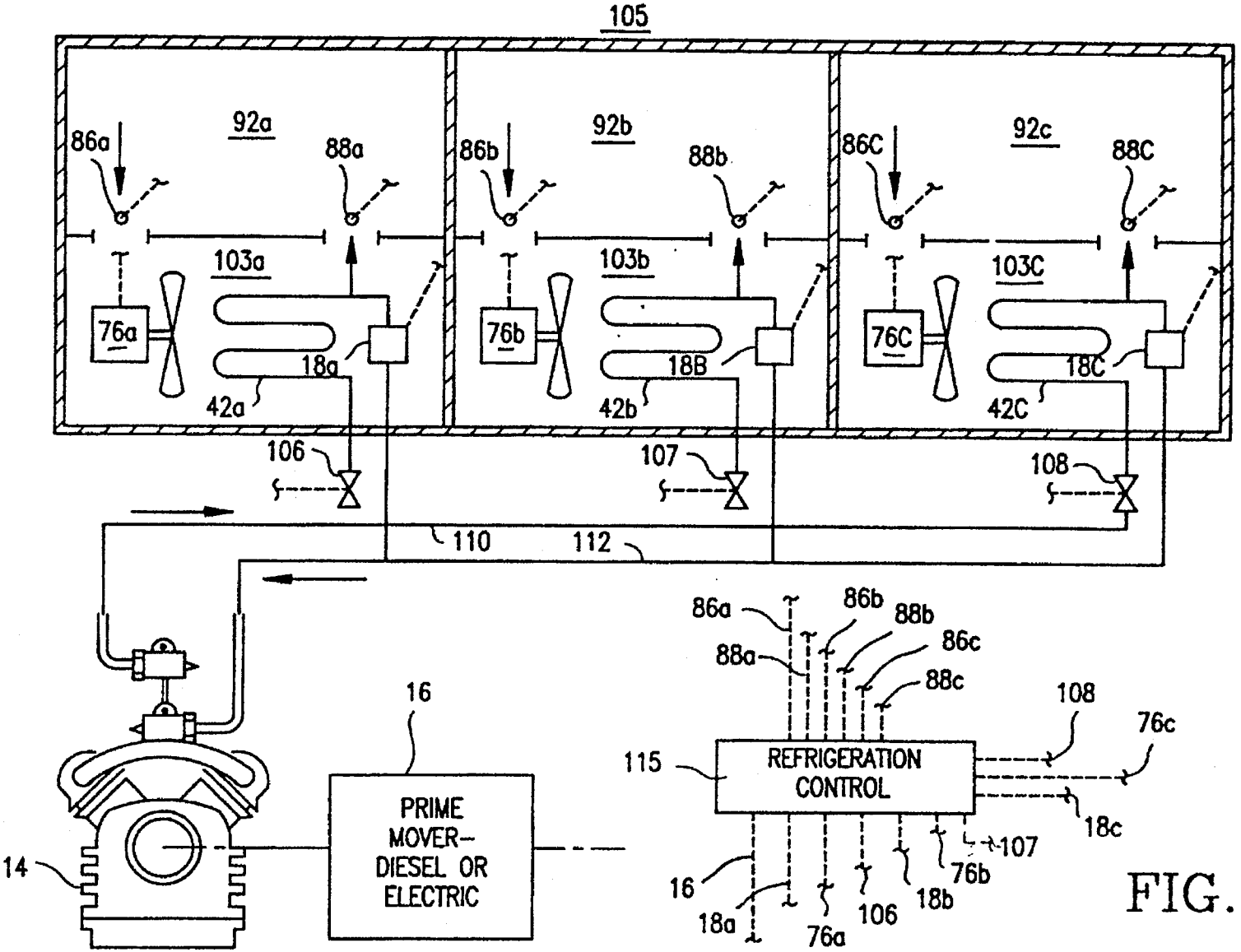
FIG. 3 is a schematic representation of a multiply conditioned space refrigeration system capable of operation in accordance with the method of the invention.

FIG. 3 illustrates a "multi-temp" refrigeration system 105 having a plurality of single refrigeration systems 103*a*,103*b*, 103*c* for heating or cooling a plurality of conditioned spaces 92*a*,92*b*,92*c*, respectively. Each of the refrigeration systems 103*a*,103*b*,103*c* includes all of the components described with respect to the system 103 of FIG. 2, with the exception that each system is powered by a single compressor 14 and prime mover 16. In particular, each system 103*a*, 103*b*, and 103*c* includes its own heater evaporator coil and coil fan combination 42*a*, 76*a*, 42*b*, 76*b*, and 42*c*, 76*c*, as well as its own three-way 18*a*, 18*b*, and 18*c*. Additionally, each of the three refrigeration systems 103*a*, 103*b*, and 103*c* includes its own temperature sensors 86*a*, 88*a*; 86*b*, 88*b*, and 86*c*, 88*c* for measuring the temperature of the discharge and return air of its respective conditioned space 92*a*, 92*b*, and 92*c* respectively. Compressed refrigerant is supplied by the compressor 14 to each of the three separate systems 103*a*, 103*b*, and 103*c* via refrigerant lines 110 and 112. Each of the systems 103*a*, 103*b*, and 103*c* is connected to the lines 110 and 112 in parallel as shown. Solenoid operated valves 106, 107, and 108 are provided to either admit or shut off refrigerant from the evaporator-heater coils 42*a*, 42*b*, and 42*c* of the three separate refrigeration systems. When any of the valves 106, 107, or 108 is closed, and the coil fan 76*a*, 76*b*, or 76*c* associated with the particular valve continues to run, the system is said to run in a "null" mode wherein the fan 76*a*, 76*b*, or 76*c* only circulates air through is respective conditioned space 92*a*, 92*b*, or 92*c* without any heating or cooling provided by the respective evaporator-heater coil 42*a*, 42*b*, or 42*c*.

Figure 4:
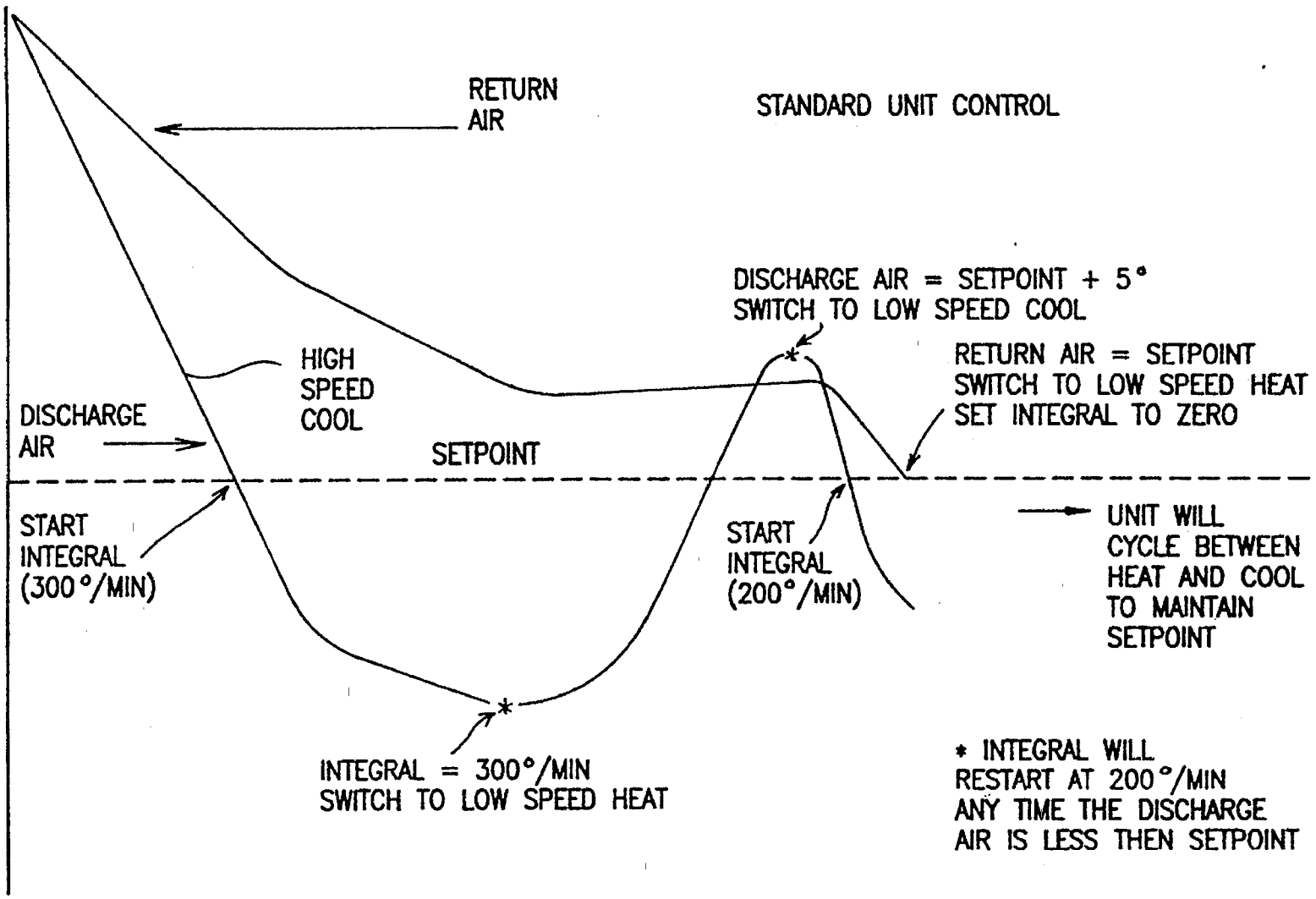
FIG. 4 is a temperature-over-time graph illustrating how setpoint is achieved in a refrigeration system capable of heating or cooling only a single conditioned space.

FIG. 4 illustrates, by way of a temperature-time graph, the implementation of the method of invention by a refrigeration system such the system 103 described with respect to FIG. 2. Such a system 103 has a single evaporator-heater coil 42 and fan 76 for heating or cooling a single conditioned space 92. In the first step of the method, the operator enters a temperature setpoint via setpoint selector 96. Typically, the entered setpoint will be less than the ambient temperature. If this is the case, the refrigeration control circuits 74 will actuate the solenoid controlled PS valve into a closed position, which will allow the spring of the three-way valve 18 to place the valve into a cooling mode position. Additionally, circuit 74 will command the prime mover 16 to operate at "high" speed, thereby driving the compressor 14, and the coil fan 76 at a high speed. The temperature of the discharge air as measured by the sensor 88 will begin to slow downwardly, as will the temperature of the return air as measured by the temperature sensor 86. However, because of the heat load applied by the items in the conditioned space 92, the temperature of the return air will typically be higher than that of the temperature of the discharged air. Consequently, when the temperature of the discharged air converges with setpoint, the temperature of the return air will be higher than setpoint. Accordingly, in order to attain setpoints without exposing any of the items in the conditioned space 92 to the danger of top-freezing, the computer contained with the refrigeration control circuit 74 starts to compute both (1) the amount of degrees Fahrenheit that the discharge air drops below the setpoint temperature, and (2) the amount of time associated with each below-setpoint temperature. From these two factors, the computer of the refrigeration control circuit 74 can compute the integral, as measured in degree minutes, that the discharge air remains below setpoint.

The inventors have found, via empirical observation, that an integral of 300° F. minutes may be used in the initial cool-down steps of the method without exposing any of the items in the conditioned space 92 to undesirable top-freezing. Accordingly, the computer of the refrigeration control circuit 74 is programmed to switch from a high-speed cooling mode to a low-speed heating mode such that the area under the temperature-time graph of the discharge air is no greater than 300° F. minutes. Of course, in the event that the temperature of the return should converge with the setpoint temperature during the initial cool down steps, the 300° F./minute integral would be foreshortened, with the refrigeration system 103 changing from a high-speed cooling mode to a low-speed heating mode as soon as convergence was attained. In such a case, the system 103 will alternate between a low-speed cooling mode and a low-speed heating mode to maintain the temperature of the return air in the neighborhood of the setpoint temperature. However, if the return air temperature does not attain setpoint during the entire 300° F./minute integral, the system 103 continues to run at a low-speed heating mode until the temperature of the discharge air is 5° F. above the setpoint temperature, whereupon the refrigeration control circuit 74 switches the system 103 to a low-speed cooling mode.

As is evident from the graph, the temperature of the discharge air will cool over time, in turn bringing down the temperature of the return air. As soon as the temperature of the discharge air intersects with the setpoint temperature, the computer of the refrigeration control circuit again reiterates the previously-described integration steps, the only difference being that the computer is programmed to maintain the discharge air below setpoint for only 200° F./minutes, instead of 300° F./minutes. The use of a smaller integral at this juncture is necessary to avoid top-freezing, as much of the latent heat within the items stored in the conditioned space 92 has been removed by the initial cool-down steps. Again, the computer of the refrigeration control circuit 74 switches the system 103 from a low-speed cooling mode, to a low-speed heating mode so that the temperature of the discharge remains below setpoint for a maximum of 200° F./minutes. Again, the integral will be terminated if the temperature of the return air converges with the setpoint temperature at any time before its expiration.

After the termination of the second integral, the refrigeration system 103 will alternate between a low-speed cooling mode and a low-speed heating mode to maintain the temperature of the return air in the vicinity of the setpoint temperature.

Figure 5:
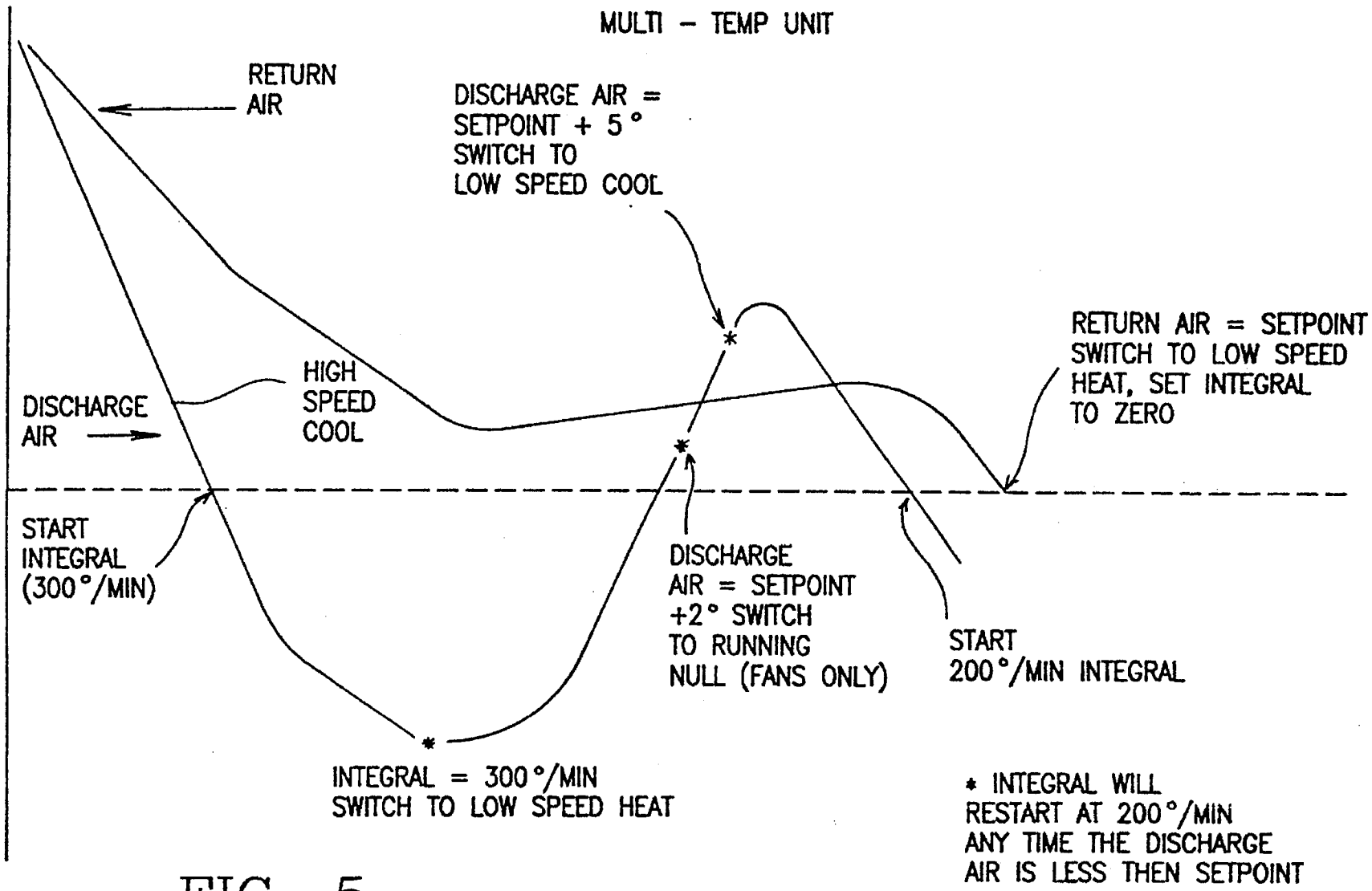
FIG. 5 is a temperature-over-time graph illustrating how setpoint is achieved in one of the conditioned spaces of a refrigeration system that utilizes a single compressor to heat and cool a plurality of conditioned spaces.

The implementation of the method of the invention is somewhat different for a multi-temp cooling system 105 of the type illustrated in FIG. 3, since the individual refrigeration systems 103*a*, 103*b*, and 103*c* are capable of operating in the previously-described null mode. FIG. 5 illustrates the implementation of the method of the invention in such a multi-temp system. While the initial pull-down steps of the invention remain the same, (i.e., during the initial pull-down steps, the computer in the refrigeration control circuit 74 allows the discharge air to descend below setpoint temperature for a maximum of 300° F./minutes). However, instead of running the individual systems 103*a*, 103*b*, and 103*c* in a low-speed heating mode at the end of the pull-down integral until the discharge air rises to 5° F. above the setpoint temperature, each system is run in a low-speed heating mode until the discharge air temperature is only 2° F. above setpoint. At this juncture, each of the individual systems 103*a*, 103*b*, or 103*c* is run in a null mode by the closing of the refrigerant valve 106, 107, or 108. In such a null mode, the respective fans 76*a*, 76*b*, or 76*c* are run at low speed in order to circulate the air through the load. When the temperature of the discharge air finally rises to 5° F. above setpoint, the refrigerant valve 106, 107, or 108 corresponding to the particular system 103*a*, 103*b*, or 103*c* is opened, and the system is run in the cooling mode at low speed. When the temperature of the discharge air again dips below setpoint, the computer of the refrigeration control circuit 74 again calculates the point at which the particular system will have to be switched from a low-speed cooling mode to a low-speed heating mode, to implement a below-setpoint integral of 200° F./minutes. Of course, if the temperature of the return air should converge with setpoint before the expiration of the 200° F./minute integral, the computer of the refrigeration control circuit 74 will immediately switch the operation of the system affected from a low-speed cooling mode to a low-speed heating mode, and vice versa in order to maintain the temperature of the return air in the neighborhood of the setpoint temperature.

What is claimed:

1. A method for controlling a transport refrigeration system capable of operating in both a cooling and heating mode and at one of a high speed or a low speed and including a refrigerant compressor driven by a prime mover, an evaporator-heater coil for receiving refrigerant from the compressor, and a coil fan for discharging a flow of air through the coil to cool or heat a conditioned space to a selected temperature setpoint, comprising the sequential steps of:

operating the system in said cooling mode at high speed for no more than a predetermined number of degree minutes below said temperature setpoint to rapidly cool said conditioned space;

operating the system in said heating mode at low speed to raise the temperature of the conditioned space to a predetermined number of degrees above setpoint to avoid top-freezing of items in said conditioned space, and operating the system in said cooling mode at low speed to reattain said temperature setpoint in said conditioned space.

2. The method of claim 1, wherein the temperature of return air in the conditioned space is monitored during said step of operating the system in said cooling mode at high speed, and wherein the step of operating said system in said heating mode at low speed commences either when said temperature of said return air is the same as said setpoint or after the expiration of said predetermined number of degree minutes.

3. The method of claim 2, further comprising the sequential steps of monitoring the temperature of the air discharged from the coil fan concurrently with the step of operating the system in said cooling mode at low speed, and commencing a timing of the number of minutes that said system is operated in said cooling mode at low speed as soon as the temperature of the discharge air is less than said setpoint of said conditioned space.

4. The method of claim 3, further comprising the step of continuing to operate said system in said cooling mode at low speed for a second predetermined number of minutes that is less than said first predetermined number of minutes or until the temperature of said return air is equal to said setpoint of said conditioned space.

5. The method of claim 4, further comprising the sequential steps of operating the system in said heating mode at low speed to raise the temperature of the conditioned space a predetermined number of degrees above setpoint to avoid top-freezing of items in said conditioned space, and then operating the system in said cooling mode at low speed to reattain said temperature setpoint in said conditioned space.

6. The method of claim 5, further comprising the step of continuing to operate said system in said cooling mode at low speed for a third predetermined number of minutes that is less than said second predetermined number of minutes or until the temperature of said return air is equal to said setpoint of said conditioned space.

7. The method of claim 6, further comprising the sequential steps of operating said system in said heating mode at low speed after the step of claim 5 to raise the temperature of the conditioned space a predetermined number of degrees above setpoint to avoid top-freezing of said items in said conditioned space, and then operating said system in said cooling mode at low speed to reattain said temperature setpoint in said conditioned space.

8. The method of claim 1, wherein said refrigeration system includes a plurality of evaporator-heater coil and coil fan combinations, each of which heats or cools one of a plurality of conditioned spaces, and each of which is capable of operating in a null mode wherein no refrigerant is circulated through said coil while said coil fan discharges air.

9. The method of claim 8, wherein each of said combinations of said system is operated in said heating mode at low speed to raise the temperature of its respective conditioned space to about 2° F. above setpoint.

10. The method of claim 9, further comprising the steps of operating each of said combinations in said null mode after said heating step until said temperature of said respective conditioned space rises to about 5° F. over setpoint, and then operating each of said combinations in said cooling mode at low speed.

11. A method for controlling a transport refrigeration system capable of operating in both a cooling and heating mode and at one of a high speed or a low speed and including a refrigerant compressor driven by a prime mover, an evaporator-heater coil for receiving refrigerant from the compressor, a coil fan for discharging a flow of air through the coil to cool or heat a conditioned space to a selected temperature set point, and sensors for detecting the temperature of discharged air and air returning from circulating through said conditioned space, respectively, comprising the sequential steps of:

operating the system in said cooling mode at high speed for no more than 300° F. minutes below said temperature setpoint to rapidly cool said conditioned space;

operating the system in said heating mode at low speed to raise the temperature of the conditioned space to 5° F. above setpoint to avoid top-freezing of items in said conditioned space, and operating the system in said cooling mode at low speed to reattain said temperature setpoint in said conditioned space.

12. The method of claim 11, wherein the temperature of return air in the conditioned space is monitored during said step of operating the system in said cooling mode at high speed, and wherein the step of operating said system in said heating mode at low speed commences either when said temperature of said return air is the same as said setpoint or after the expiration of said 300° F. minutes.

13. The method of claim 12, further comprising the sequential steps of monitoring the temperature of the air discharged from the coil fan concurrently with the step of operating the system in said cooling mode at low speed, and commencing a timing of the number of minutes that said system is operated in said cooling mode at low speed as soon as the temperature of the discharge air is less than said setpoint of said conditioned space.

14. The method of claim 13, further comprising the step of continuing to operate said system in said cooling mode at low speed for 200° F. minutes or until the temperature of said return air is equal to said setpoint of said conditioned space.

15. The method of claim 14, further comprising the sequential steps of operating the system in said heating mode at low speed to raise the temperature of the conditioned space no more than 5° above setpoint to avoid top-freezing of items in said conditioned space, and then operating the system in said cooling mode at low speed to reattain said temperature setpoint in said conditioned space.

16. The method of claim 15, further comprising the step of continuing to operate said system in said cooling mode for 100° F. minutes or until the temperature of said return air is equal to said setpoint of said conditioned space.

17. The method of claim 11, wherein said refrigeration system includes a plurality of evaporator-heater coil and coil fan combinations, each of which heats or cools one of a plurality of conditioned spaces, and each of which is capable of operating in a null mode wherein no refrigerant is circulated through said coil while said coil fan discharges air.

18. The method of claim 17, wherein each of said combinations of said system is operated in said heating mode at low speed to raise the temperature of its respective conditioned space to about 2° F. above setpoint.

19. The method of claim 18, further comprising the steps of operating each of said combinations in said null mode after said heating step until said temperature of said respective conditioned space rises to about 5° F. over setpoint, and then operating each of said combinations in said cooling mode at low speed.

20. The method of claim 19, further comprising the step of continuing to operate said system in said cooling mode at low speed for 200° F. minutes or until the temperature of said return air is equal to said setpoint of said conditioned space.

* * * * *